US007900696B1

(12) United States Patent
Nish et al.

(10) Patent No.: US 7,900,696 B1
(45) Date of Patent: Mar. 8, 2011

(54) DOWNHOLE TOOL WITH EXPOSABLE AND OPENABLE FLOW-BACK VENTS

(75) Inventors: Randall W. Nish, Provo, UT (US); Randy A. Jones, Park City, UT (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 62 days.

(21) Appl. No.: 12/253,319

(22) Filed: Oct. 17, 2008

Related U.S. Application Data

(60) Provisional application No. 61/089,302, filed on Aug. 15, 2008.

(51) Int. Cl.
*E21B 23/00* (2006.01)
*E21B 33/12* (2006.01)

(52) U.S. Cl. ..... 166/133; 166/376

(58) Field of Classification Search ..... 166/118, 166/119, 120, 126, 128, 129, 133, 334.4, 166/376, 387
See application file for complete search history.

(56) References Cited

U.S. PATENT DOCUMENTS

| | | | | |
|---|---|---|---|---|
| 1,684,266 | A | | 9/1928 | Fisher et al. |
| 2,043,225 | A | | 6/1936 | Armentrout et al. |
| 2,160,804 | A | | 5/1939 | Hall et al. |
| 2,205,119 | A | | 6/1940 | Hall et al. |
| 2,230,712 | A | | 2/1941 | Bendeler et al. |
| 2,338,326 | A | | 1/1944 | Green |
| 2,577,068 | A | | 12/1951 | Baker |
| 2,589,506 | A | | 3/1952 | Morrisett |
| 2,672,199 | A | | 3/1954 | McKenna |
| 2,725,941 | A | | 12/1955 | Henshaw |
| 3,136,365 | A | | 6/1964 | Carter et al. |
| 3,163,225 | A | | 12/1964 | Perkins |
| 3,211,232 | A | | 10/1965 | Grimmer |
| 3,298,440 | A | | 1/1967 | Current |
| 3,306,366 | A | | 2/1967 | Muse |
| 3,314,480 | A | | 4/1967 | Scott |
| 3,420,304 | A | | 1/1969 | Kilgore |
| 3,497,003 | A | | 2/1970 | Berryman et al. |
| 3,517,742 | A | | 6/1970 | Williams |
| 3,831,677 | A | * | 8/1974 | Mullins ..... 166/128 |
| 3,976,133 | A | | 8/1976 | Allen |
| 4,099,563 | A | | 7/1978 | Hutchison et al. |
| 4,151,875 | A | | 5/1979 | Sullaway |
| 4,289,200 | A | | 9/1981 | Fisher, Jr. |
| 4,312,406 | A | | 1/1982 | McLaurin et al. |
| 4,397,351 | A | | 8/1983 | Harris |
| 4,432,418 | A | | 2/1984 | Mayland |

(Continued)

OTHER PUBLICATIONS

Baker Hughes Baker Oil Tools Remedial Systems Technical Unit QUIK Drill Composite Bridge Plug and Wireline Adapter Kit PRoduct Family Nos. H40129 and H43848, Feb. 28, 2002, pp. 1-12.

(Continued)

*Primary Examiner* — Kenneth Thompson
*Assistant Examiner* — Michael Wills, III
(74) *Attorney, Agent, or Firm* — Thorpe North & Western LLP

(57) ABSTRACT

A down hole flow control tool for use in a well bore, such as a bridge or frac plug, includes back-flow vent holes in a central mandrel and initially covered by a member on the mandrel, such as a lower slip or a lower cone. In a subsequent, set configuration, the member moves away from the vent hole allowing back flow of well fluids.

21 Claims, 4 Drawing Sheets

U.S. PATENT DOCUMENTS 4,488,595 A 12/1984 Akkerman
4,524,825 A 6/1985 Fore
4,532,989 A 8/1985 Barker
4,553,596 A 11/1985 Graham et al.
4,664,188 A 5/1987 Zunkel et al.
4,708,202 A 11/1987 Sukup et al.
4,730,835 A 3/1988 Wilcox et al.
4,739,829 A 4/1988 Brunner
4,745,972 A 5/1988 Bell et al.
4,784,226 A 11/1988 Wyatt
4,813,481 A 3/1989 Sproul et al.
4,834,184 A 5/1989 Streich et al.
4,858,687 A 8/1989 Watson et al.
5,086,839 A 2/1992 Setterberg, Jr. et al.
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A 12/1993 Streich et al.
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A * 4/1995 Bohlen et al. ..... 166/387
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 11/2003 Solfronk et al.
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,168,494 B2 1/2007 Starr et al.
7,210,533 B2 5/2007 Starr et al.
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,380,600 B2 6/2008 Willberg et al.
7,395,856 B2 7/2008 Murray
7,452,161 B2 11/2008 Freyer et al.
7,461,699 B2 12/2008 Richard et al.
7,464,764 B2 12/2008 Xu
7,510,018 B2 3/2009 Williamson et al.
2002/0070503 A1 6/2002 Zimmerman et al.
2002/0162662 A1 11/2002 Passamaneck et al.
2003/0155112 A1 8/2003 Tiernan et al.
2004/0003928 A1 1/2004 Frazier
2004/0036225 A1 2/2004 Ritter et al.
2004/0045723 A1 3/2004 Slup et al.
2004/0177952 A1 9/2004 Turley et al.
2005/0161224 A1 7/2005 Starr et al.
2005/0189103 A1 9/2005 Roberts et al.
2005/0205264 A1 9/2005 Starr et al.
2006/0124307 A1 6/2006 Turley et al.
2006/0131031 A1 6/2006 McKeachnie et al.
2006/0278405 A1 12/2006 Turley et al.
2007/0039160 A1 2/2007 Turley et al.
2007/0074873 A1 4/2007 McKeachnie et al.
2007/0102165 A1 5/2007 Slup et al.
2007/0119600 A1 5/2007 Slup et al.
2007/0284097 A1 12/2007 Swor et al.
2007/0284114 A1 12/2007 Swor et al.
2008/0047717 A1 2/2008 Frazier et al.
2008/0073074 A1 3/2008 Frazier
2008/0073081 A1 3/2008 Frazier et al.
2008/0202764 A1 8/2008 Clayton et al.
2008/0257549 A1 10/2008 Swor et al.
2009/0038790 A1 2/2009 Barlow
2009/0044957 A1 2/2009 Clayton et al.
2009/0065194 A1 3/2009 Frazier
2009/0065216 A1 3/2009 Frazier
2009/0078647 A1 3/2009 Frazier et al.
2009/0139720 A1 6/2009 Frazier
2009/0159274 A1 6/2009 Frazier
2009/0178808 A1 7/2009 Williamson et al.

OTHER PUBLICATIONS

Weatherford FracGuard Composite Plugs, 2004, 7 pages.
BJ Python Composite Bridge Plug, Product Information Sep. 20, 2001, 1 page.
Halliburton FAS Drill Squeeze Packers, Drillable Tools, 1999, 6 pages.

Weatherford Completion Systems FracGuard Series Composite Frac Plug 2001, Brochure No: 432.00 & 433.00; 2 pages.
BioBalls MR, Soluble Ball Sealers, www.santrol.com, Applicant believes that the Bioballs were offered for sale prior to the filing date of applicant's application.
Nish, et al., U.S. Appl. No. 12/353,655, filed Jan. 14, 2009.
Jon Vogel, et al., U.S. Appl. No. 12/549,652, filed Aug. 28, 2009.
Nish, et al., U.S. Appl. No. 12/253,337, filed Oct. 17, 2008.

* cited by examiner

DOWNHOLE TOOL WITH EXPOSABLE AND OPENABLE FLOW-BACK VENTS

RELATED APPLICATIONS

This is related to U.S. patent application Ser. No. 11/800,448, filed May 3, 2007; which is hereby incorporated by reference.

This is related to U.S. Provisional Patent Application Ser. No. 61/089,302, filed Aug. 15, 2008; which is hereby incorporated by reference.

This is related to U.S. patent application Ser. No. 12/253,337, filed Oct. 17, 2008, entitled "Combination Anvil and Coupling for Bridge and Fracture Plugs"; which is hereby incorporated by reference.

BACKGROUND

1. Field of the Invention

The present invention relates generally to well completion devices and methods for completing wells, such as natural gas and oil wells. More particularly, this invention relates to a well completion plug, method and/or kit, that includes flow-back vents.

2. Related Art

Just prior to beginning production, oil and natural gas wells are completed using a complex process called "fracturing." This process involves securing the steel casing pipe in place in the well bore with cement. The steel and cement barrier is then perforated with shaped explosive charges. The surrounding oil or gas reservoir is stimulated or "fractured" in order to start the flow of gas and oil into the well casing and up to the well head. This fracturing process can be repeated several times in a given well depending on various geological factors of the well, such as the depth of the well, size and active levels in the reservoir, reservoir pressure, and the like. Because of these factors, some wells may be fractured at only a few elevations along the well bore and others may be fractured at as many as 30 or more elevations.

As the well is prepared for fracturing at each desired level or zone of the well, a temporary plug is set in the bore of the steel well casing pipe just below the level where the fracturing will perforate the steel and cement barrier. When the barrier is perforated, "frac fluids" and sand are pumped down to the perforations, and into the reservoir. At least a portion of the fluids and sand are then drawn back out of the reservoir in order to stimulate movement of the gas or oil at the perforation level. Use of the temporary plug prevents contaminating the already fractured levels below.

This process is repeated several times, as the "frac" operation moves up the well bore until all the desired levels have been stimulated. At each level, the temporary plugs are usually left in place, so that they can all be drilled out at the end of the process, in a single, but often time-consuming drilling operation. One reason the drilling operation has been time intensive is that the temporary plugs have been made of cast iron which has generally required many hours and, occasionally, several passes of the drilling apparatus to completely drill out the plug. To reduce the drill out time, another type of down hole plug has been developed that is made of a composite material. Composite plugs are usually made of, or partially made of, a fiber and resin mixture, such as fiberglass and high performance plastics. Due to the nature of the composite material, composite plugs can be easily and quickly drilled out of a well bore in a single pass drilling operation.

Alternatively, it has been proposed to combust or burn the plug or a portion thereof in order to eliminate its obstruction in the well casing.

Temporary well plugs used in the fracturing operation described above, whether made of cast iron or composite materials, often come in two varieties, bridge plugs and frac plugs. Bridge plugs restrict fluid movement in the upward and downward direction. Bridge plugs are used to temporarily or permanently seal off a level of the well bore. Frac plugs generally behave as one-way valves that restrict fluid movement down the well bore, but allow fluid movement up the well bore.

In use, when frac fluids and sand are pumped down to a newly perforated level of the well bore, a frac plug set in the well bore just below the perforation level can restrict the frac fluids and sand from traveling farther down the well bore and contaminating lower fractured levels. However, when the frac fluid and sand mixture is pumped back up the well to stimulate the reservoir at the newly fractured level, the one-way valve of the frac plug can open and allow gas and oil from lower levels to be pumped to the well head. This is advantageous to the well owner because it provides immediate revenue even while the well is still being completed. This upward flow can also assist in drilling out the plugs.

SUMMARY OF THE INVENTION

The improvement of well completion methods and devices is an ongoing endeavor. It has been recognized that it would be advantageous to develop a plug with back flow vents that are concealed or protected during setting of the plug to avoid contamination, damage and/or fouling of vents; but that are openable subsequent to setting of the plug. In addition, it has been recognized that it would be advantageous to develop a plug that is combustible and better suited for use with a burn device that causes combustion of some or all of the plug components.

The invention provides a down hole flow control device for use in a well bore, such as a bridge plug or a frac plug. The device includes one or more back-flow vent holes disposed radially in a central mandrel and extending radially from a hollow of the central mandrel to an exterior of the mandrel. One or more members can be disposed on the mandrel, such as packers, slips, cones, etc. One or more of the members can cover the vent holes in an initial, unset configuration. In the initial, set configuration, the vent holes remain covered. In both the frac and bridge plug configurations, when the pressure above exceeds the pressure from below the mandrel strokes downward. In a subsequent, set configuration, the members can compress and the mandrel can stroke downwardly with respect to the members exposing the vent holes, allowing back flow of well fluids. In the case of a bridge plug, if the pressure from below exceeds the pressure above, the mandrel can stroke upward and the vent holes become covered.

In one aspect of the present invention, the device includes a central mandrel sized and shaped to fit within a well bore and including a hollow therein. At least one member is disposed on the central mandrel and movable with respect to the central mandrel along a longitudinal axis of the central mandrel. The at least one member includes a packer ring compressible along the longitudinal axis of the central mandrel to form a seal between the central mandrel and the well bore. At least one back-flow vent hole is disposed radially in the central mandrel and extends radially from the hollow of the central mandrel to an exterior of the central mandrel. The at least one member is disposed over the at least one back-flow vent hole in an initial, unset configuration of the device, and disposed away from the at least one back-flow vent hole in a subsequent, set configuration of the device.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
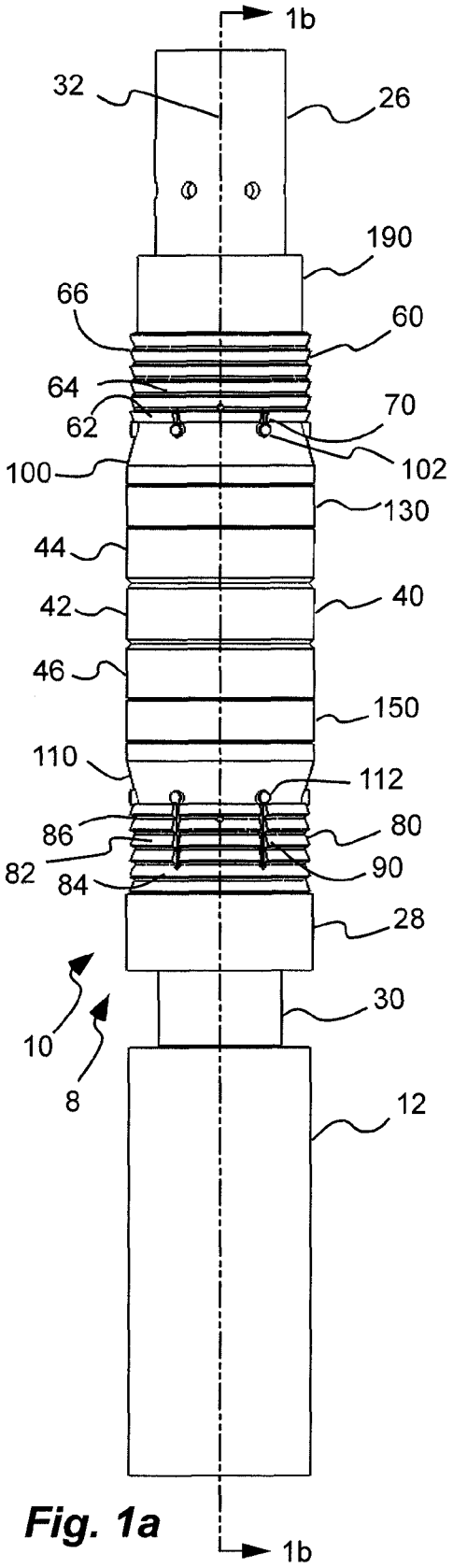
FIG. 1*a* is a side view of a plug or down-hole tool in accordance with an embodiment of the present invention shown in an initial, unset configuration, and with a burn device installed thereon.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1*a*-4, a remotely deployable, disposable, consumable down hole flow control device, indicated generally at 10, in accordance with an embodiment of the present invention is shown for use in a well bore as a down hole tool or plug. The down hole flow control device 10 can be remotely deployable at the surface of a well and can be disposable so as to eliminate the need to retrieve the device. One way the down hole flow control device 10 can be disposed is by drilling or machining the device out of the well bore after deployment. Another way the down hole flow control device 10 can be disposed is by combusting or burning all or some of the components thereof using a burn device. Thus, the down hole flow control device 10 can be used as a down hole tool such as a frac plug, indicated generally at 6 and shown in FIGS. 3 and 4, a bridge plug, indicated generally at 8 and shown in FIGS. 1*a*-*d*, a cement retainer (not shown), well packer (not shown), a kill plug (not shown), and the like in a well bore as used in a gas or oil well. The down hole flow control device 10 includes a central mandrel 20 with a hollow 24 that can extend axially, or along a longitudinal axis of the mandrel, throughout a length of the device to form a flow path for well fluids depending on the use of the device, such as when configured as a frac plug 6. Alternatively, the hollow 24 may not extend the length of the mandrel 20.

A burn device 12 can be attached to, or operatively associated with, the down hole flow control device 10 to selectively cause the device or various components to burn and fall down the well bore to the "rat hole." The burn device can include fuel, oxygen, an igniter and a control or activation system that allow the burn device to combust the flow control device 10. The burn device 12 can be attached to a bottom of the mandrel 20, and can be inserted into the hollow 24 or otherwise cover a bottom of the hollow. The down hole flow control device 10 can include back-flow vents, such as back-flow vent holes 4, to allow the flow of well fluids around the burn device, through the vent holes 4, through the hollow 24, and up the well bore. It will be appreciated that such holes can become damaged or clogged during positioning and setting of the device 10. Therefore, in one aspect of the present invention, the back-flow vent holes 4 can be covered while positioning and setting of the device to protect the holes, and subsequently uncovered for use, as described more fully below. One or more members can be disposable on the mandrel 20 to cover the vent holes 4 before the device is set, and movable to expose the vent holes 4 after it is set.

The central mandrel 20 can be sized and shaped to fit within a well bore, tube or casing for an oil or gas well. The central mandrel 20 can have a cylindrical body 22 with a hollow 24 or hollow center that can be open on a proximal end 26. The body 22 can be sized and shaped to fit within a well bore and have a predetermined clearance distance from the well bore wall or casing. The central mandrel 20 can also have a cylindrical anvil or bottom stop 28 on a distal end 30. The anvil or bottom stop 28 can be sized and shaped to fit within the well bore and substantially fill the cross sectional area of the well bore. In one aspect, the diameter of the anvil or bottom stop 28 can be smaller than the diameter of the well bore or casing such that well fluids can flow around the bottom stop between the bottom stop and well casing.

Figure 3:
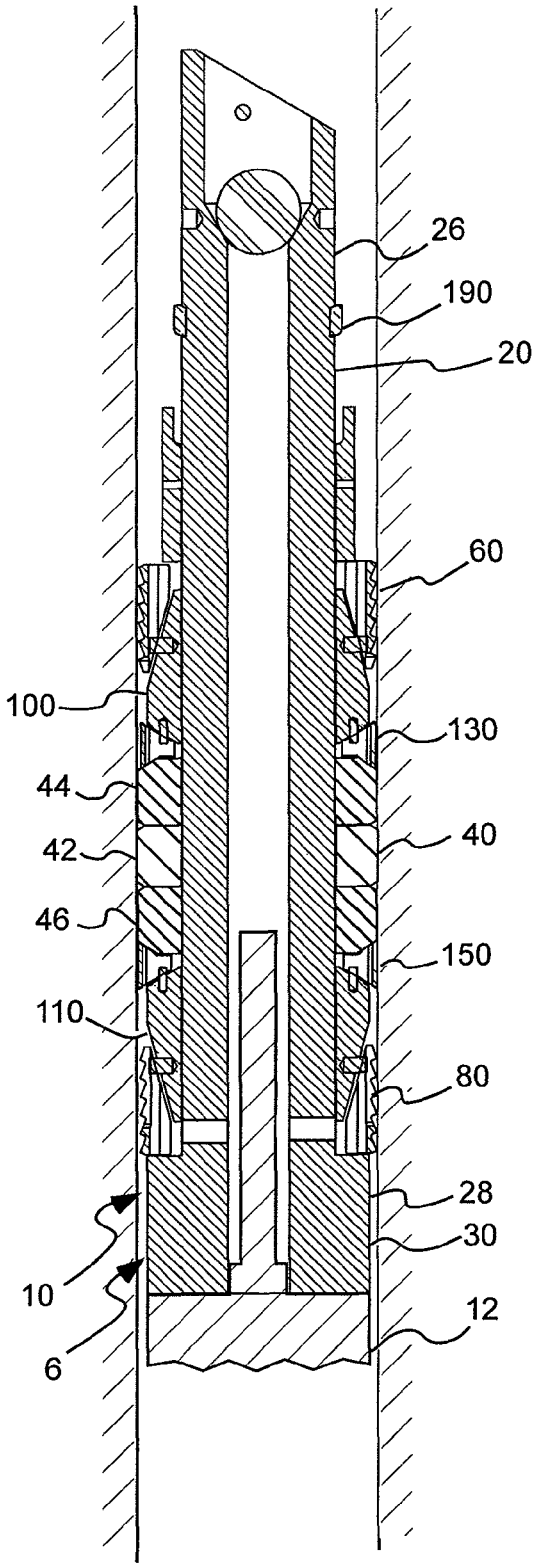
FIG. 3 is a cross-sectional schematic view of the plug or down-hole tool of FIG. 1*a* shown in a set configuration in a well bore.

The proximal end 26 can be angled with respect to the longitudinal axis, indicated by a dashed line at 32, of the central mandrel (as shown in FIG. 3) or can have teeth or lugs so as to accommodate placement in the well bore adjacent other down hole tools or flow control devices or burn devices. The angle of the end 26 can correspond and match with an angled end or mate with teeth or lugs of the adjacent down hole tool or flow control device or burn device so as to rotationally secure the two devices together, thereby restricting rotation of any one device in the well bore with respect to other devices in the well bore.

The central mandrel 20 can be formed of a material that is easily drilled or machined, such as cast iron, fiber and resin composite, and the like. In the case where the central mandrel 20 is made of a composite material, the fiber can be rotationally wound in plies having predetermined ply angles with respect to one another and the resin can have polymeric properties suitable for extreme environments, as known in the art. In one aspect, the composite article can include an epoxy resin with a curing agent. Additionally, other types of resin devices, such as bismaleimide, phenolic, thermoplastic, and the like can be used. The fibers can be E-type and ECR type glass fibers as well as carbon fibers. It will be appreciated that other types of mineral fibers, such as silica, basalt, and the like, can be used for high temperature applications. Alternatively, the mandrel 20 can be formed of material that is combustible, such as magnesium, aluminum or the like.

One or more members are disposed on the central mandrel 20 and movable with respect to the central mandrel along a longitudinal axis 32 of the central mandrel. The members can include at least one packer ring (or a set of packer rings) that are compressible along the axis and expandable radially to form a seal between the mandrel and the well bore; at least one fracturable slip ring (or a pair of slip rings) to fracture and displace radially to secure the plug in the well bore; at least one cone (or a pair of cones) to slid between the slip ring and the mandrel to cause the slip ring to fracture and displace radially; etc.

A compressible packer ring 40 can be disposed on the mandrel 20 or cylindrical body 22 (FIG. 2*a*) of the central mandrel 20. The packer ring 40 can have an outer diameter just slightly smaller than the diameter of the well bore and can correspond in size with the anvil or bottom stop 28 of the central mandrel. The packer ring 40 can be compressible along the longitudinal axis 32 of the central mandrel 20 and radially expandable in order to form a seal between the central mandrel 20 and the well bore. The packer ring 40 can be formed of an elastomeric polymer that can conform to the shape of the well bore or casing and the central mandrel 20.

In one aspect, the packer ring 40 can be formed of three rings, including a central ring 42 and two outer rings 44 and 46 on either side of the central ring. In this case, each of the three rings 42, 44, and 46 can be formed of an elastomeric material having different physical properties from one another, such as durometer, glass transition temperatures, melting points, and elastic modulii, from the other rings. In this way, each of the rings forming the packer ring 40 can withstand different environmental conditions, such as temperature or pressure, so as to maintain the seal between the well bore or casing over a wide variety of environmental conditions.

An upper slip ring 60 and a lower slip ring 80 can also be disposed on the central mandrel 20 with the upper slip ring 60 disposed above the packer ring 40 and the lower slip ring 80 disposed below the packer ring 40. Each of the upper and lower slip rings 60 and 80 can include a plurality of slip segments 62 and 82, respectively, that can be joined together by fracture regions 64 and 84 respectively, to form the rings 62 and 82. The fracture regions 64 and 84 can facilitate longitudinal fractures to break the slip rings 60 and 80 into the plurality of slip segments 62 and 82. Each of the plurality of slip segments can be configured to be displaceable radially to secure the down hole flow control device 10 in the well bore.

The upper and lower slip rings 60 and 80 can have a plurality of raised ridges 66 and 86, respectively, that extend circumferentially around the outer diameter of each of the rings. The ridges 66 and 86 can be sized and shaped to bite into the well bore wall or casing. Thus, when an outward radial force is exerted on the slip rings 60 and 80, the fracture regions 64 and 84 can break the slip rings into the separable slip segments 62 and 82 that can bite into the well bore or casing wall and wedge between the down hole flow control device and the well bore. In this way, the upper and lower slip segments 62 and 82 can secure or anchor the down hole flow control device 10 in a desired location in the well bore.

The upper and lower slip rings 60 and 80 can be formed of a material that is easily drilled or machined so as to facilitate easy removal of the down hole flow control device from a well bore. For example, the upper and lower slip rings 60 and 80 can be formed of a cast iron or composite material. Additionally, the fracture regions 64 and 84 can be formed by stress concentrators, stress risers, material flaws, notches, slots, variations in material properties, and the like, that can produce a weaker region in the slip ring.

In one aspect, the upper and lower slip rings 60 and 80 can be formed of a composite material including fiber windings, fiber mats, chopped fibers, or the like, and a resin material. In this case, the fracture regions can be formed by a disruption in the fiber matrix, or introduction of gaps in the fiber matrix at predetermined locations around the ring. In this way, the material difference in the composite article can form the fracture region that results in longitudinal fractures of the ring at the locations of the fracture regions.

In another aspect, the upper and lower slip rings 60 and 80 can be formed of a cast material such as cast iron. The cast iron can be machined at desired locations around the slip ring to produce materially thinner regions such as notches or longitudinal slots 70 and 90 in the slip ring that will fracture under an applied load. In this way, the thinner regions in the cast iron ring can form the fracture region that results in longitudinal fractures of the ring at the locations of the fracture regions. In another aspect, the upper and lower slip rings 60 and 80 can be formed of a material that is combustible.

In yet another aspect, the upper and lower slip rings 60 and 80 can also have different fracture regions 64 and 84 from one another. For example, the fracture regions 64 and 84 can include longitudinal slots spaced circumferentially around the ring, the longitudinal slots 90 of the lower slip ring 80 can be larger than the slots 70 of the upper slip ring 60. Thus, the fracture regions 84 of the lower slip ring 80 can include less material than the fracture regions 64 of the upper slip ring 60. In this way, the lower slip ring 80 can be designed to fracture before the upper slip ring 60 so as to induce sequential fracturing with respect to the upper and lower slip rings 60 and 80 when an axial load is applied to both the upper slip ring and the lower slip ring.

It will be appreciated that compression of the packer ring 40 can occur when the distance between the upper and lower slip rings 60 and 80 is decreased such that the upper and lower slip rings 60 and 80 squeeze or compress the packer ring 40 between them. Thus, if the slip rings fracture under the same load, or at the same approximate time during the compression operation, the distance between the two rings 60 and 80 may not be small enough to have sufficiently compressed the packer ring 40 so as to form an adequate seal between the central mandrel 20 and the well bore or casing wall. In contrast, the sequential fracturing mechanism of the down hole flow control device 10 described above advantageously allows the lower slip ring 80 to set first, while the upper slip ring 60 can continue to move longitudinally along the central mandrel 20 until the upper slip ring 60 compresses the packer ring 40 against the lower slip ring 80. In this way, the lower slip ring 80 sets and anchors the tool to the well bore or casing wall and the upper ring 60 can be pushed downward toward the lower ring 80, thereby squeezing or compressing the packer ring 40 that is sandwiched between the upper and lower slip rings 60 and 80.

The down hole flow control device 10 can also include a top stop 190 disposed about the central mandrel 20 adjacent the upper slip ring. The top stop 190 can be secured to the mandrel 20 to resist the mandrel 20 from sliding out of the packer 40 when the mandrel strokes down under pressure from above. Alternatively, the top stop can move along the longitudinal axis of the central mandrel such that the top stop can be pushed downward along the central mandrel to move the upper slip ring 60 toward the lower slip ring 80, thereby inducing the axial load in the upper and lower slip rings and the compressible packer ring 40. In this way, the compressible packer ring 40 can be compressed to form the seal between the well bore all or casing and the central mandrel 20.

The down hole flow control device 10 can also include an upper cone 100 and a lower cone 110 that can be disposed on the central mandrel 20 adjacent the upper and lower slip rings 60 and 80. Each of the upper and lower cones 100 and 110 can be sized and shaped to fit under the upper and lower slip rings 60 and 80 so as to induce stress into the upper or lower slip ring 60 and 80, respectively. The upper and lower cones 100 and 110 can induce stress into the upper or lower slip rings 60 and 80 by redirecting the axial load pushing the upper and lower slip rings together against the anvil 28 and the packer ring 40 to a radial load that can push radially outward from under the upper and lower slip rings. This outward radial loading can cause the upper and lower slip rings 60 and 80 to fracture into slip segments 62 and 82 when the axial load is applied and moves the upper slip ring 60 toward the lower slip ring 80.

The upper and lower cones 100 and 110 can be formed from a material that is easily drilled or machined such as cast iron or a composite material. In one aspect the upper and lower cones 100 and 110 can be fabricated from a fiber and resin composite material with fiber windings, fiber mats, or chopped fibers infused with a resin material. Advantageously, the composite material can be easily drilled or machined so as to facilitate removal of the down hole flow control device 10 from a well bore after the slip segments have engaged the well bore wall or casing. Alternatively, the upper and lower cones 100 and 110 can be formed of a combustible material, such as magnesium or aluminum or the like.

The upper and lower cones 100 and 110 can also include a plurality of stress inducers 102 and 112 disposed about the upper and lower cones. The stress inducers 102 and 112 can be pins that can be set into holes in the conical faces of the upper and lower cones 60 and 80, and dispersed around the circumference of the conical faces. The location of the pins around the circumference of the cones can correspond to the location of the fracture regions 64 and 84 (or the slots) of the upper and lower slip rings 60 and 80. In this way, each stress inducer 102 and 112 can be positioned adjacent a corresponding respective fracture region 64 or 84, respectively, in the upper and lower slip rings. Advantageously, the stress inducers 102 and 112 can be sized and shaped to transfer an applied load from the upper or lower cone 100 and 110 to the fracture regions 64 and 84 of the upper or lower slip rings 60 or 80, respectively, in order to cause fracturing of the slip ring at the fracture region and to reduce uneven or unwanted fracturing of the slip rings at locations other than the fracture regions. Additionally, the stress inducers 102 and 112 can help to move the individual slip segments into substantially uniformly spaced circumferential positions around the upper and lower cones 100 and 110, respectively. In this way the stress inducers 102 and 112 can promote fracturing of the upper and lower slip rings 60 and 80 into substantially similarly sized and shaped slip segments 62 and 82.

The down hole flow control device 10 can also have an upper backing ring 130 and a lower backing ring 150 disposed on the central mandrel 20 between the packer ring 40 and the upper and lower slip rings 60 and 80, respectively. In one aspect, the upper and lower backing rings 130 and 150 can be disposed on the central mandrel 20 between the packer ring 40 and the upper and lower cones 100 and 110, respectively. The upper and lower backing rings 130 and lower 150 can be sized so as to bind and retain opposite ends 44 and 46 of the packer ring 40.

Figure 4:
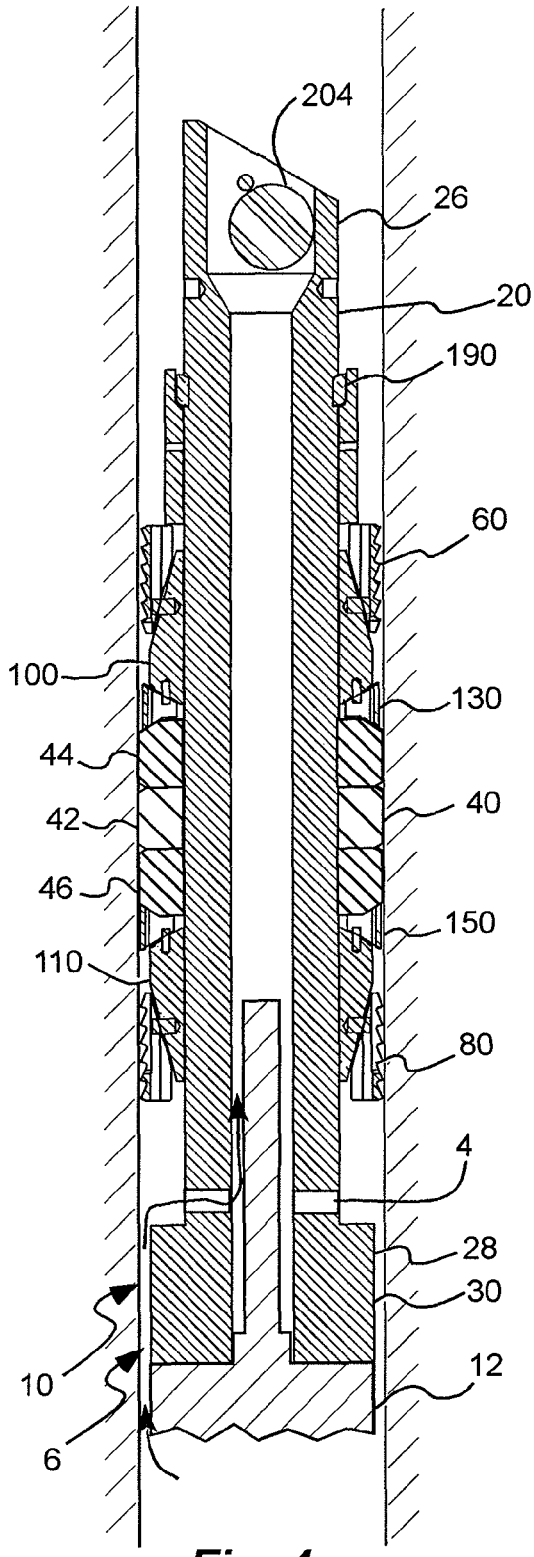
FIG. 4 is a cross-sectional schematic view of the plug or down-hole tool of FIG. 1*a* shown in a set configuration in a well bore and with the central mandrel stroked downward.

It will be appreciated that the down hole flow control device 10 described herein can be used with a variety of down hole tools. Thus, as indicated above, FIGS. 3 and 4 show the down hole flow control device 10 used with a frac plug, indicated generally at 6, and FIGS. 1*a-d* show the down hole flow control device 10 used with a bridge plug, indicated generally at 8. Referring to FIGS. 3 and 4 the down hole flow control device, indicated generally at 10 can secure or anchor the central mandrel 20 to the well bore wall or casing so that a one way check valve 204, such as a ball valve, can allow flow of fluids from below the plug while isolating the zone below the plug from fluids from above the plug. Referring to FIGS. 1*a-d*, the down hole flow control device, indicated generally at 10, can secure or anchor the central mandrel to the well bore wall or casing so that a solid plug 208 can resist pressure from either above or below the plug in order to isolate the a zone in the well bore. Advantageously, the down hole flow control device 10 described herein can be used for securing other down hole tools such as cement retainers, well packers, and the like.

Figure 1B:
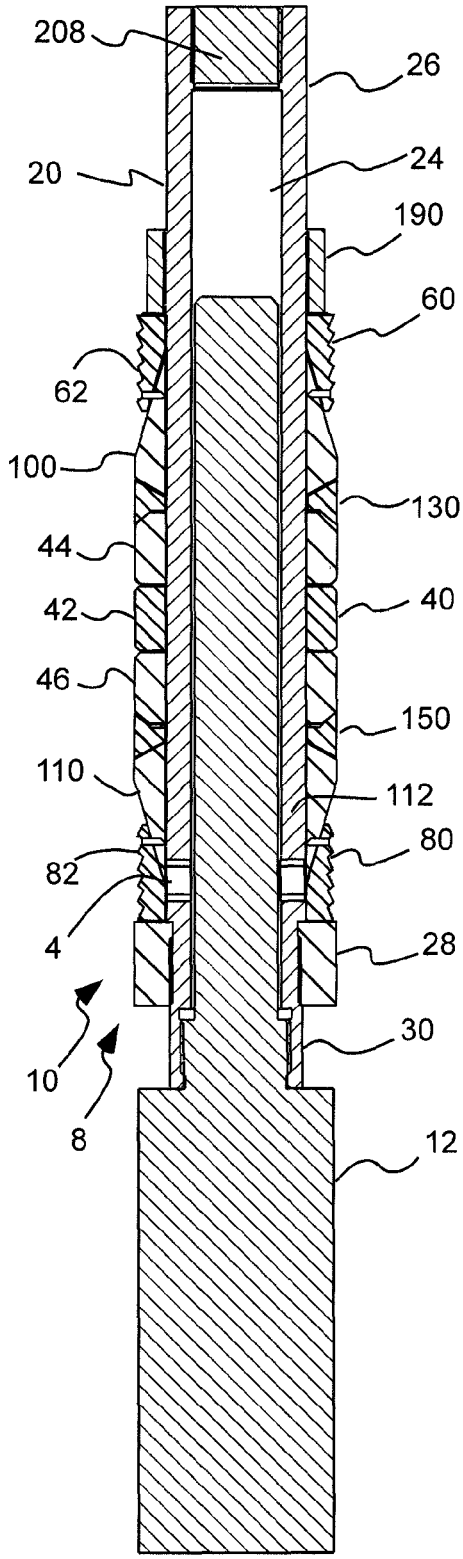
FIG. 1*b* is a cross-sectional view of the plug or down-hole tool of FIG. 1*a* taken along line 1*a*-1*a* in FIG. 1*a*, again shown with a burn device installed thereon.
Figure 1C:
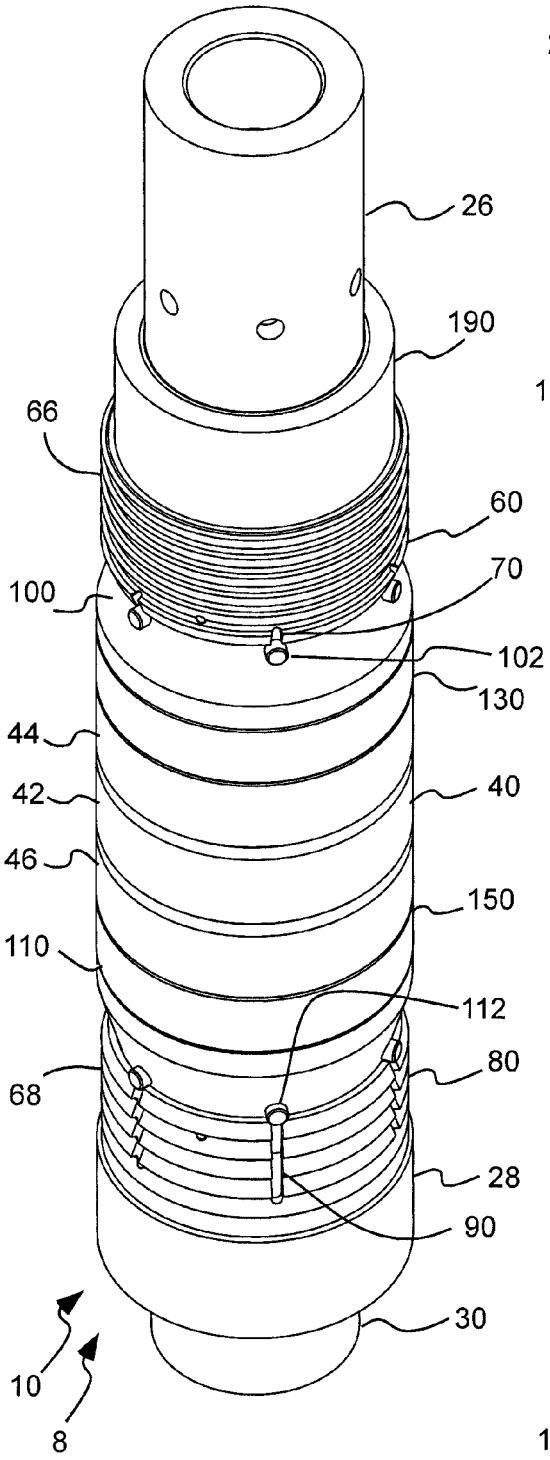
FIG. 1*c* is a perspective view of the plug or down-hole tool of FIG. 1*a;*
Figure 1D:
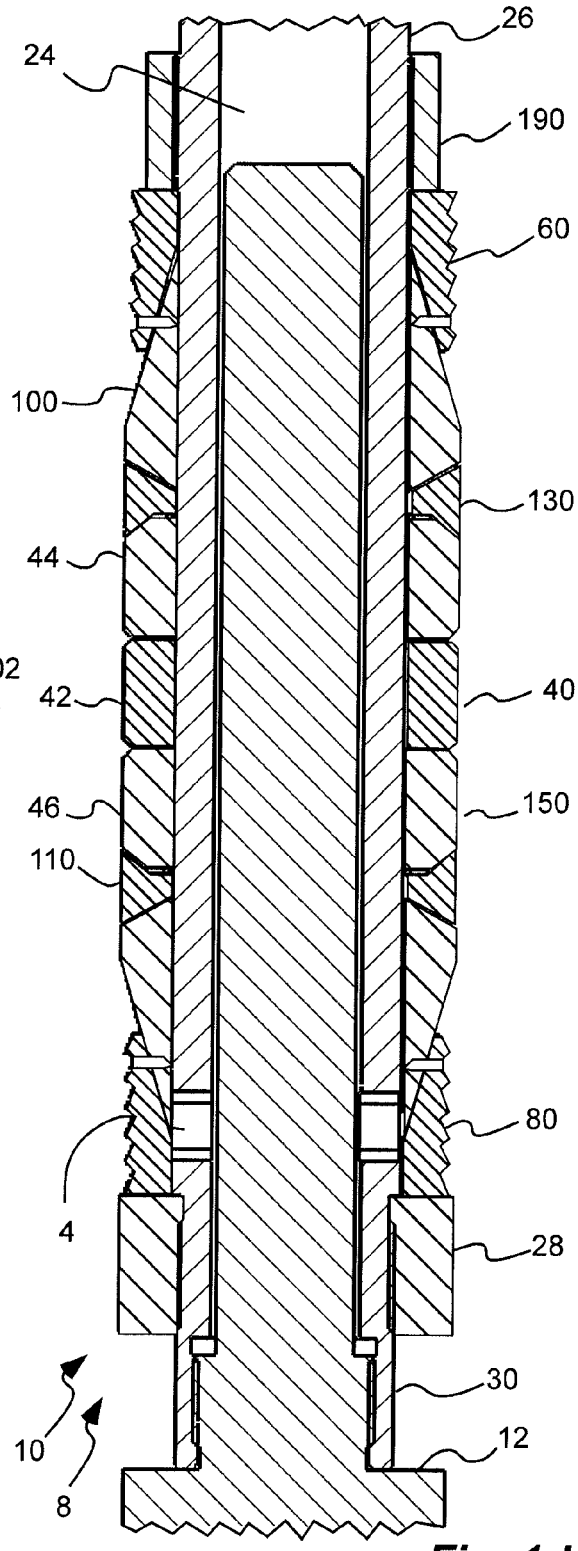
FIG. 1*d* is a partial cross-sectional view of the plug or down-hole tool of FIG. 1*b;*
Figure 2A:
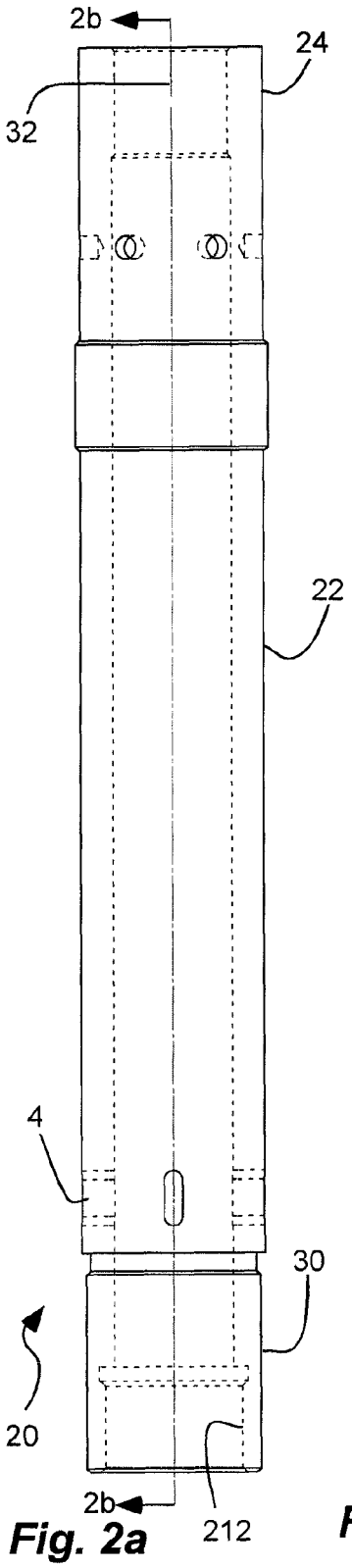
FIG. 2*a* is a side view of a central mandrel of the plug or down-hole tool of FIG. 1*a* in accordance with an embodiment of the present invention.
Figure 2B:
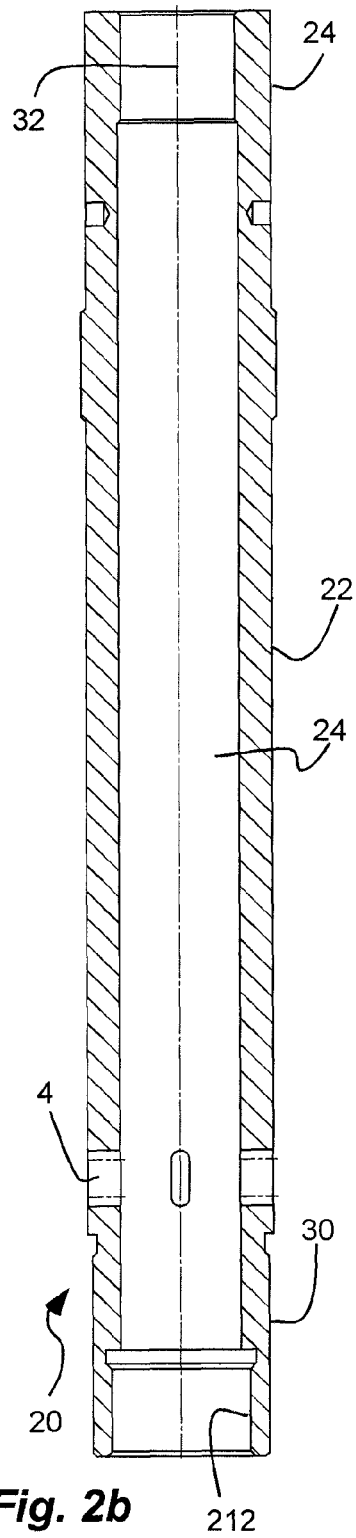
FIG. 2*b* is a cross sectional view of the central mandrel of FIG. 2*a* taken along line 2*b*-2*b* in FIG. 2*a;*
Figure 2C:
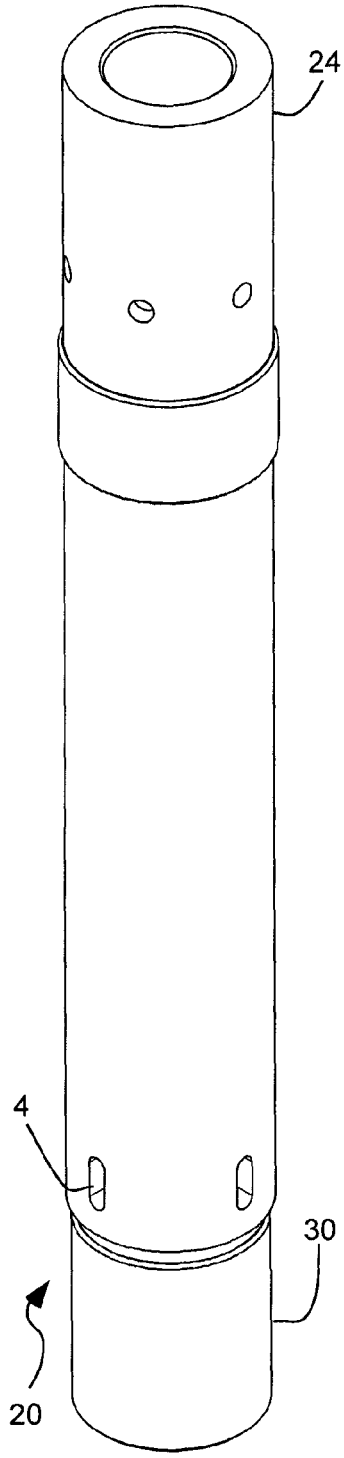
FIG. 2*c* is a perspective view of the central mandrel of FIG. 2*a;*

As described above, one or more back-flow vent holes 4 can be disposed radially in the central mandrel 20 and extending radially from the hollow 24 of the central mandrel to an exterior of the central mandrel. One or more members, such as the lower slip 80 and/or lower cone 110, can be disposed on the mandrel 20 and disposed over the at least one back-flow vent hole 4 in an initial, unset configuration of the device, as shown in FIGS. 1*b* and 1*d*, and disposed away from the at least one back-flow vent hole in a subsequent, set configuration, as shown in FIG. 4. The vent holes 4 can be disposed near a bottom of the mandrel 20, near or adjacent the bottom stop 28. In the initial, unset configuration shown in FIGS. 1*b* and 1*d*, the various members, such as the packer 40, slips 60 and 80, cones 100 and 110, etc. can be held uncompressed between the top stop 190 and the bottom stop 28. In the subsequent, set configuration shown in FIG. 3, the various members are compressed between the top stop 190 and the bottom stop 28. Pressure from above the device can cause the mandrel 20 to stroke downwardly such that the various members, compressed between the top and bottom stops, move upwardly with respect to the mandrel 20, exposing the vent holes 4, as shown in FIG. 4. With the vent holes 4 exposed, well fluids, such as oil, gas, etc. can pass through the vent holes 4 and up the hollow 24 as shown by the arrows. As described above, the burn device 12 can be secured to a bottom of the mandrel 20.

The mandrel 20 can include a bottom bore 212 in which the burn device 12 is secured. For example, the bottom bore 212 can be threaded and the burn device can include a threaded portion so that the burn device can be threaded onto the mandrel. With the device 10 configured as a frac plug 6, and the burn device 12 secured to the bottom bore, the fluid flow passage through the hollow 24 is blocked, and the exposed vent holes 4 allow back flow of well fluids and operation of the device as a frac plug.

In use, a down hole flow control device is lowered into a well bore. A downward force is applied on the upper slip 60 to compress the upper and lower slip rings and the packer ring so as to break the lower slip ring into slip segments to secure the flow control device to the well bore, to form a seal between the central mandrel and the well bore by compressing the packer ring, and to break the upper slip ring into slip segments to further secure the flow control device to the well bore after the packer ring has been compressed to form the seal. After use, the device can be drilled out or combusted.

Although the above description and embodiments in the drawings show the plug configured for use with a burn device, it will be appreciated that the plug of the present invention can be used without a burn device.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A down hole flow control device for use in a well bore, comprising:

a) a central mandrel sized and shaped to fit within a well bore and including a hollow therein, the central mandrel being combustible;

b) at least one member disposed on the central mandrel and movable with respect to the central mandrel along a longitudinal axis of the central mandrel, the at least one member including a packer ring compressible along the longitudinal axis of the central mandrel to form a seal between the central mandrel and the well bore;

c) at least one back-flow vent hole disposed radially in the central mandrel and extending radially from the hollow of the central mandrel to an exterior of the central mandrel;

d) the at least one member covering the at least one back-flow vent hole in an initial, unset configuration of the device, and movable along the longitudinal axis of the mandrel to uncover the at least one back-flow vent hole in a subsequent, set configuration of the device; and a burn device coupled at a bottom of the central mandrel and covering a bottom opening of the hollow in the central mandrel, and including fuel and oxygen.

2. A device in accordance with claim 1, wherein the hollow of the central mandrel extends axially therethrough; and wherein the central mandrel includes a bottom bore configured to receive and attach to the burn device.

3. A device in accordance with claim 1, wherein the at least one member further comprises:

a) at least one slip ring disposed on the central mandrel and including a plurality of slip segments joined together by fracture regions to form the slip ring, the fracture regions being configured to facilitate longitudinal fractures to break the slip ring into the plurality of slip segments, and each of the plurality of slip segments being configured to secure the down hole flow control device in the well bore; and b) at least one cone disposed on the central mandrel adjacent the at least one slip ring and being sized and shaped to induce stress into the slip ring to cause the slip ring to fracture into slip segments when an axial load is applied to the slip ring; and c) wherein at least one of the at least one slip ring and the at least one cone is disposed over the at least one back-flow vent hole in the initial, unset configuration of the device, and disposed away from the at least one back-flow vent hole in the subsequent, set configuration of the device.

4. A device in accordance with claim 1, wherein the at least one back-flow vent hole is located adjacent a bottom stop of the central mandrel.

5. A device in accordance with claim 1, further comprising:

a bottom stop disposed lower on the central mandrel and a top stop disposed higher on the mandrel with the at least one member including the packer ring disposed between the bottom stop and the top stop;

the device being set by compressing the at least one member including the packer ring toward the bottom stop; and the central mandrel being subsequently strokable so that the at least one member including the packing ring is disposed against the top stop and exposing the at least one back-flow vent opening.

6. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore;

b) at least one back-flow vent hole disposed radially in the central mandrel extending from a hollow of the central mandrel to an exterior of the central mandrel;

c) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the ring, the fracture regions being configured to facilitate longitudinal fractures to break the slip rings into the plurality of slip segments, and each of the plurality of slip segments being configured to secure the down hole flow control device in the well bore;

d) an upper cone and a lower cone disposed on the central mandrel adjacent the upper slip ring and the lower slip ring, respectively, each of the upper and lower cones being sized and shaped to induce stress into the upper and lower slip rings, respectively, to cause the slip rings to fracture into slip segments when an axial load is applied to the slip rings;

e) at least one of the lower slip ring and lower cone covering the at least one back-flow vent hole in an initial, unset configuration of the device, and movable along the longitudinal axis of the mandrel to uncover the at least one back-flow vent hole in a subsequent, set configuration of the device; and f) a burn device coupled to the central mandrel and including fuel and oxygen.

7. A device in accordance with claim 6, wherein the burn device is coupled at a bottom of the central mandrel and covers a bottom opening of the hollow in the central mandrel.

8. A device in accordance with claim 6, wherein the hollow of the central mandrel extends axially therethrough; and wherein the central mandrel includes a bottom bore configured to receive and attach to the burn device.

9. A device in accordance with claim 6, wherein the at least one back-flow vent hole is located adjacent a bottom stop of the central mandrel.

10. A device in accordance with claim 6, further comprising:

a bottom stop disposed lower on the central mandrel and a top stop disposed higher on the mandrel with the slip rings, the cones, and the packer ring disposed between the bottom stop and the top stop;

the device being set by compressing the slip rings, the cones, and the packer ring toward the bottom stop; and the central mandrel being subsequently strokable so that the slip rings, the cones, and the packing ring are together disposed against the top stop and exposing the at least one back-flow vent opening.

11. A down hole flow control device for use in a well bore, comprising:

a) a central mandrel sized and shaped to fit within a well bore and including a packer ring disposed thereon, the packer ring being compressible along a longitudinal axis of the central mandrel to form a seal between the central mandrel and the well bore, the central mandrel also including a hollow extending axially therein;

b) at least one back-flow vent hole disposed radially in the central mandrel extending from the hollow of the central mandrel to an exterior of the central mandrel;

c) an upper slip ring and a lower slip ring disposed on the central mandrel, the upper slip ring disposed above the packer ring and the lower slip ring disposed below the packer ring, each of the upper and lower slip rings including a plurality of slip segments joined together by fracture regions to form the ring, the fracture regions being configured to facilitate longitudinal fractures to break the slip rings into the plurality of slip segments, and each of the plurality of slip segments being configured to secure the down hole flow control device in the well bore;

d) an upper cone and a lower cone disposed on the central mandrel adjacent the upper slip ring and the lower slip ring, respectively, each of the upper and lower cones being sized and shaped to induce stress into the upper and lower slip rings, respectively, to cause the slip rings to fracture into slip segments when an axial load is applied to the slip rings;

e) at least one of the lower slip ring and lower cone covering the at least one back-flow vent hole in an initial, unset configuration of the device, and movable along the longitudinal axis of the mandrel to uncover the at least one back-flow vent hole in a subsequent, set configuration of the device; and f) a bottom bore disposed in a bottom of the central mandrel configured to receive and attach to a burn device having fuel and oxygen configured to burn at least a portion of the device.

12. A device in accordance with claim 11, wherein the central mandrel is combustible and further comprising:

a burn device coupled to the central mandrel and including fuel and oxygen.

13. A device in accordance with claim 12, wherein the burn device covers a bottom bore in the central mandrel.

14. A device in accordance with claim 11, wherein the at least one back-flow vent hole is located adjacent a bottom stop of the central mandrel.

15. A device in accordance with claim 11, further comprising:

a bottom stop disposed lower on the central mandrel and a top stop disposed higher on the mandrel with the at least one member including the packer ring disposed between the bottom stop and the top stop;

the device being set by compressing the at least one member including the packer ring toward the bottom stop; and the central mandrel being subsequently strokable so that the at least one member including the packing ring is disposed against the top stop and exposing the at least one back-flow vent opening.

16. A device in accordance with claim 11, further comprising:

the upper and lower slip rings having different fracture regions from one another to induce sequential fracturing with respect to the upper and lower slip rings when an axial load is applied to both the upper slip ring and the lower slip ring; and the fracture region of the lower slip ring is configured to fracture before the upper slip ring under the axial load so as to induce fracture of the lower slip ring before the upper slip ring under the axial load.

17. A device in accordance with claim 11, further comprising:

a plurality of stress inducers disposed about the upper and lower cones, each stress inducer corresponding to a respective fracture region in the upper and lower slip rings, and sized and shaped to transfer an applied load from the upper or lower cone to the fracture regions of the upper or lower slip rings to reduce uneven fracturing of the slip rings into slip segments and to provide substantially even circumferential spacing of the slip segments.

18. A device in accordance with claim 11, further comprising:

an upper backing ring and a lower backing ring disposed on the central mandrel between the packer ring and the upper and lower slip rings, respectively, each of the upper and lower backing rings further including:

a plurality of backing segments disposed circumferentially around the central mandrel; and a plurality of fracture regions disposed between respective backing segments, the fracture regions being configured to fracture the upper and lower backing rings into the plurality of backing segments when the axial load induces stress in the fracture regions, and the backing segments being sized and shaped to reduce longitudinal extrusion of the packer ring when the packer ring is compressed to form the seal between the central mandrel and the well bore.

19. A down hole flow control device for use in a well bore, comprising:

a) a central mandrel sized and shaped to fit within a well bore and including a hollow therein;

b) at least one member disposed on the central mandrel and movable with respect to the central mandrel along a longitudinal axis of the central mandrel, the at least one member including a packer ring compressible along the longitudinal axis of the central mandrel to form a seal between the central mandrel and the well bore;

c) a bottom stop disposed lower on the central mandrel and a top stop disposed higher on the mandrel with the at least one member including the packer ring disposed between the bottom stop and the top stop;

d) the device being set by compressing the at least one member including the packer ring toward the bottom stop e) at least one back-flow vent hole disposed radially in the central mandrel and extending radially from the hollow of the central mandrel to an exterior of the central mandrel;

f) the at least one member covering the at least one back-flow vent hole in an initial, unset configuration of the device, and movable along the longitudinal axis of the mandrel to uncover the at least one back-flow vent hole in a subsequent, set configuration of the device; and g) the central mandrel being subsequently strokable so that the at least one member including the packing ring is disposed against the top stop and exposing the at least one back-flow vent opening.

20. A device in accordance with claim 19, wherein the central mandrel is combustible and further comprising:

a burn device coupled to the central mandrel and including fuel and oxygen.

21. A device in accordance with claim 19, wherein the at least one member further comprises:

a) at least one slip ring disposed on the central mandrel and including a plurality of slip segments joined together by fracture regions to form the slip ring, the fracture regions being configured to facilitate longitudinal fractures to break the slip ring into the plurality of slip segments, and each of the plurality of slip segments being configured to secure the down hole flow control device in the well bore; and b) at least one cone disposed on the central mandrel adjacent the at least one slip ring and being sized and shaped to induce stress into the slip ring to cause the slip ring to fracture into slip segments when an axial load is applied to the slip ring; and c) wherein at least one of the at least one slip ring and the at least one cone is disposed over the at least one back-flow vent hole in the initial, unset configuration of the device, and disposed away from the at least one back-flow vent hole in the subsequent, set configuration of the device.

* * * * *